US010745248B2

(12) United States Patent
Liu et al.

(10) Patent No.: US 10,745,248 B2
(45) Date of Patent: Aug. 18, 2020

(54) HANDRAIL BELT TENSION DEVICE FOR ESCALATOR

(71) Applicants: KONE ELEVATORS CO., LTD., Yushan Town, Kunshan, Jiangsu (CN); KONE CORPORATION, Helsinki (FI)

(72) Inventors: Lining Liu, Yushan Town (CN); Yajun Dong, Yushan Town (CN)

(73) Assignees: KONE ELEVATORS CO., LTD., Kunshan, Jiangsu (CN); KONE CORPORATION, Helsinki (FI)

( * ) Notice: Subject to any disclaimer, the term of this patent is extended or adjusted under 35 U.S.C. 154(b) by 0 days.

(21) Appl. No.: 16/268,130

(22) Filed: Feb. 5, 2019

(65) Prior Publication Data

US 2019/0241405 A1 Aug. 8, 2019

(30) Foreign Application Priority Data

Feb. 6, 2018 (CN) ..... 2018 1 0116049

(51) Int. Cl.
*B66B 23/20* (2006.01)
*B66B 23/24* (2006.01)

(52) U.S. Cl.
CPC ..... *B66B 23/20* (2013.01); *B66B 23/24* (2013.01)

(58) Field of Classification Search
CPC ..... B66B 23/20; B66B 23/04
USPC ..... 198/336
See application file for complete search history.

(56) References Cited

U.S. PATENT DOCUMENTS 2,660,286 A * 11/1953 Margles ..... B66B 23/20 198/336
10,457,524 B2 * 10/2019 Dong ..... B66B 23/04

FOREIGN PATENT DOCUMENTS

JP 2013-95536 A 5/2013
JP 2017-159974 A 9/2017

OTHER PUBLICATIONS

Extended European Search Report, dated Jul. 8, 2019, for European Application No. 19155495.5.

* cited by examiner

*Primary Examiner* — Gene O Crawford
*Assistant Examiner* — Lester Rushin, III
(74) *Attorney, Agent, or Firm* — Birch, Stewart, Kolasch & Birch, LLP

(57) ABSTRACT

A handrail belt tension device is provided for an escalator having a truss and an annular handrail belt rotatable relative to the truss. The handrail belt tension device includes: a base plate on which a roller for supporting the handrail belt is provided, and a guiding mechanism which is fixed to the truss. The base plate is connected to the guiding mechanism, and rotatable and translatable relative to the guiding mechanism so as to adjust the handrail belt by the base plate thereby the handrail belt can be in a well tensioned status. The handrail belt tension device ensures that the tension device is installed in a more accurate position, making it easier to adjust the tensioning force of the handrail belt, reducing the time for adjusting the handrail belt, and increasing the service life of the handrail belt.

16 Claims, 7 Drawing Sheets

HANDRAIL BELT TENSION DEVICE FOR ESCALATOR

TECHNICAL FIELD

The present invention relates to the field of escalators and, in particular, to a handrail belt tension device for an escalator.

BACKGROUND

In the escalator handrail belt system, the deviation of the length of the handrail belt, due to manufacturing reasons, the length of the handrail belt changes after the escalator running for long time, so a tension structure of the handrail belt is needed to guide the handrail belt and eliminate the influence of the handrail belt length variation, and keep a reasonable tensity status to ensure the handrail belt can run normally.

The currently widely used solution to fix a handrail belt tension device is that a bending part having a long slot therein is generally used as a base plate of the tension device, or a base plate of the tension device is connected by a bending part (similar to the structure shown in FIG. 1) and the bending part is directly fixed on the truss. However, due to the bending part angle deviation and dimensional error caused by the manufacturing, the base plate of the tension device is difficult to be installed in the right position, so that the support and guide rollers are difficult to be in the right position, which causes the handrail belt to deviate from the design trace and escape from the roller, resulting in a shortened life of the handrail belt.

Another problem with the prior art is that at the tension bolt, the force cannot be controlled when the handrail belt is tensioned, and the tensioning force cannot be measured.

To this end, a new solution is needed to more easily and more accurately tension the handrail belt, saving operating time and extending the life of the handrail belt.

SUMMARY

In order to solve the above technical problems, in one aspect, the present invention provides a handrail belt tension device for an escalator, the escalator comprising a truss and an annular handrail belt rotatable relative to the truss, wherein the handrail belt tension device comprises: a base plate on which a roller for supporting the handrail belt is provided; and a guiding mechanism which is fixed to the truss; and wherein the base plate is connected to the guiding mechanism, and rotatable and translatable relative to the guiding mechanism so as to adjust the handrail belt by the base plate thereby the handrail belt can be in a well tensioned status.

In a preferable embodiment, the base plate is fixed relative to the guiding mechanism after the base plate is adjusted into position.

In a preferable embodiment, the base plate can be fixed to the guiding mechanism by a first fastener.

In a preferable embodiment, the base plate can be fixed directly to the truss by at least one second fastener.

In a preferable embodiment, the guiding mechanism comprises a guide rod, and the base plate comprises a first protrusion fixed on the base plate and having a first through hole; wherein the first through hole allows the guide rod to pass therethrough so as to allow the first protrusion and the base plate to rotate about the guide rod and translate along the length direction of the guide rod, and after the base plate is adjusted into position, the first protrusion can be fixed to the guide by the first fastener.

In a preferable embodiment, the guide rod includes a flat surface extending along the length direction thereof for engaging with the first fastener.

In a preferable embodiment, the device further comprises a tension mechanism including a first part fixed to the truss and a second part movable relative to the first part, the second part being connected to the base plate so as to move the base plate together with it.

In a preferable embodiment, the first part includes a bracket fixed to the truss and having a second through hole oriented parallel to the length direction of the guide rod, and the second part includes a tension rod, the second through hole allowing the tension rod to pass therethrough so as to allow the tension rod to rotate relative to the bracket and translate in a direction parallel to the length direction of the guide rod.

In a preferable embodiment, the tension rod is fixedly connected to the base plate, and the second part further comprises a ruler having a predetermined length and disposed on the tension rod, and a spring located between the bracket and the ruler such that, the spring is compressed as the ruler moves toward the bracket, and that, a designated edge of the ruler can be substantially aligned with corresponding edge of the bracket when the spring is compressed to a predetermined length, thereby indicating to the operator that the handrail belt is in a reasonably tensioned status.

In a preferable embodiment, the base plate further comprises a second protrusion fixed to the base plate for fixed connection with the tension rod.

In a preferable embodiment, the tension rod is a threaded rod and can be fixed to the bracket by a nut, and the ruler can be fixed to the threaded rod by a nut.

In a preferable embodiment, further comprising a first component fixed to the truss and a second component connected between the first component and the guiding mechanism.

In a preferable embodiment, the second component comprises a first connecting part and a second connecting part disposed substantially perpendicular to the first connecting part, the first connecting part and the second connecting part being respectively fixed to the first component and the guiding mechanism by at least one third fastener and at least one fourth fastener, respectively.

In a preferable embodiment, the second component further comprises at least one rib connected between the first connecting part and the second connecting part.

In a preferable embodiment, the first component is provided with a long slot oriented along the longitudinal direction of the truss, the long slot allowing at least one third fastener to move therein so as to allow the second component to translate along the longitudinal direction of the truss.

In a preferable embodiment, the length direction of the guide rod is arranged parallel to the longitudinal direction of the truss.

In a preferable embodiment, the first connecting part is provided with at least one first oblong hole corresponding to at least one third fasteners and oriented along the width direction of the truss to allow at least one third fastener to move therein so as to allow the second member to translate along the width direction of the truss.

In a preferable embodiment, the second connecting part is provided with at least one second oblong hole corresponding to at least one fourth fasteners and oriented along the transverse direction of the truss to allow at least one fourth fastener to move therein so as to allow the guiding mechanism to translate along the transverse direction of the truss.

In another aspect, the present invention provides an escalator comprising a handrail belt tension device for an escalator as described above.

Advantages of this invention of a handrail belt tension device for an escalator may include, the tension device can be installed in a more accurate position; the tension of the handrail belt can be adjusted more easily; the tension device of the handrail belt can be installed more quickly in factory; it reduces much more time to re-adjust the handrail belt on site; and it reduces the wear of the handrail belt, keep running condition of the handrail belt, and further increase the lifetime of the handrail belt.

BRIEF DESCRIPTION OF THE DRAWINGS

The above and other features and advantages of the present invention will become more apparent from the detailed description of the appended claims. The following description and drawings are for illustrative purposes only and are not intended to limit the scope of the invention, wherein:

DETAILED DESCRIPTION

The above and other technical contents, features and technical effects of the present invention will be apparent from the following detailed description of embodiments. The descriptions below are intended to be inclusive of the specific details, and are to be construed as illustrative only.

Throughout the specification and claims of the present application, the word "comprising" and variations means "including but not limited to" and is not intended to exclude other components, integers or steps. It should be understood that the singular forms "a", "an" and "the" contain plural reference, unless the context clearly dictates otherwise. In addition, although the terms "first" and "second" may be used to describe various elements of the invention, they are not intended to limit the corresponding elements. For example, the above description is not intended to limit the order or importance of the corresponding elements. The above description is used to distinguish one component from another, and the "first component" can be written as a "second component" without departing from the scope of the invention.

When an element is referred to as "connected" to another element, this may mean that it is directly connected to the other element, but it should be understood that an intermediate element may be existed. Alternatively, when an element is referred to as "directly connected" to another element, it should be understood that there is no intermediate element between the two elements. Similarly, when an element is referred to as "fixed" to another element, there may be an intermediate element; when the element is referred to as "directly fixed" to another element, it should be understood that there is no intermediate element between the two elements.

It should be noted that the directional terms mentioned in the text, such as up, down, left, right, front, back, etc., are merely directions with reference to the drawings, and the directional terms used are illustrative but not intended to limit the invention.

The specific structure and working principle of the handrail belt tension device for an escalator will be described below in conjunction with the drawings in accordance with preferred embodiments of the present invention.

Figure 2:
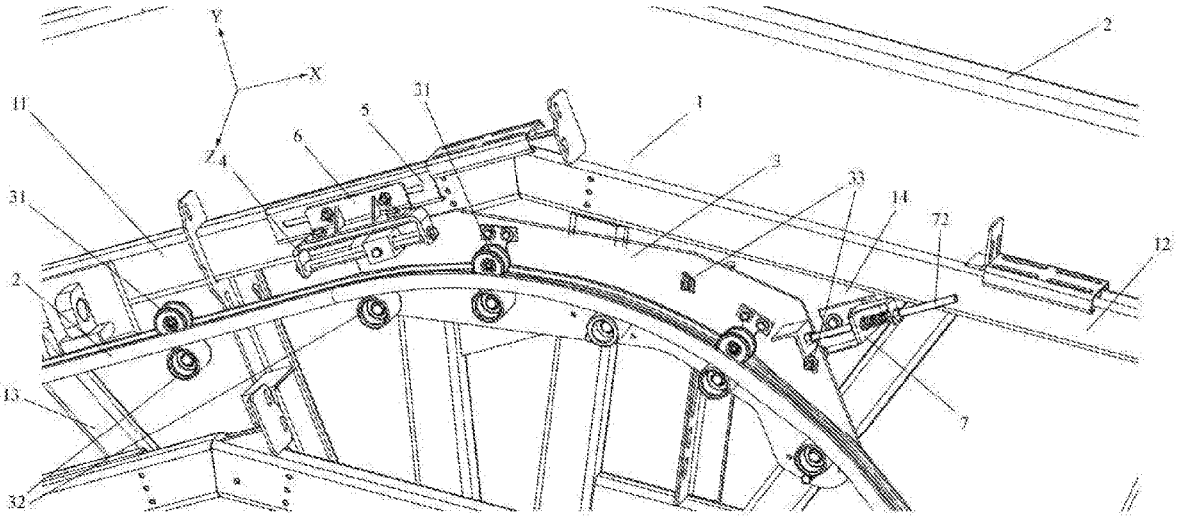
FIG. 2 is a perspective view of a handrail belt tension device for an escalator according to a preferred embodiment of the invention.

The escalator generally includes a drive system, a truss, steps, balustrades, handrail belts, and the like. The handrail belt is of annular shape and is rotated by the drive system. FIG. 2 partially shows the truss 1 of the escalator, which may include transverse beams 11, 12, vertical beams 13, support plates 14, profile steel and the like. In the illustrated embodiment, the transverse beam 11 is parallel to the direction of movement of the steps which runs obliquely, and the transverse beam 12 is parallel to the direction of movement of the steps which runs horizontally. At the joint of the transverse beams 11, 12, the direction of movement of the handrail belt 2 of the escalator changes from the direction along the transverse beam 11 of the truss 1 into a downward direction in the illustration. Preferably, the handrail belt tension device of this invention is disposed here.

The handrail belt tension device generally comprises a base plate 3 and a guiding mechanism 4. The guiding mechanism 4 can be directly fixed to the truss 1, such as the transverse beam 11, by fasteners. Support rollers 32 for supporting the handrail belt 2 are provided on the base plate 3, and guide rollers 31 or the like for guiding the movement of the handrail belt 2 may also be provided. The base plate 3 is connected to the guiding mechanism 4 and is rotatable and translatable relative to the guiding mechanism 4 so as to adjust the handrail belt by the base plate, thereby the handrail belt can be in a well tensioned state.

Figure 3:
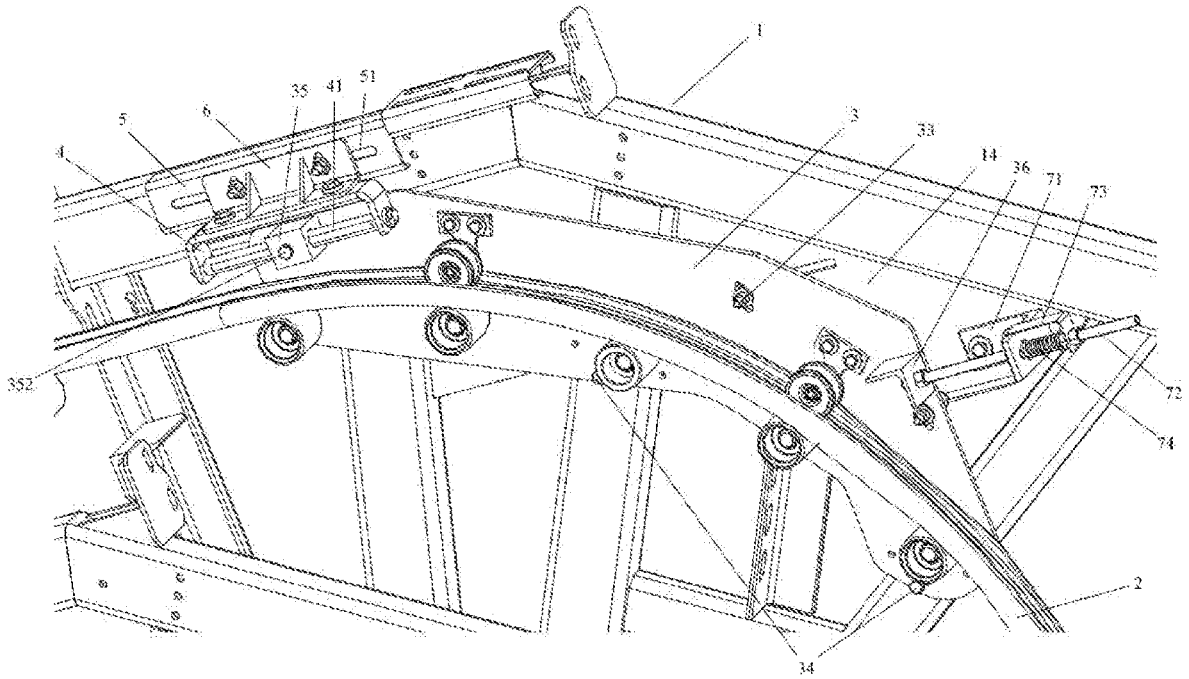
FIG. 3 is a perspective view of a handrail belt tension device for an escalator according to a preferred embodiment of the invention.
Figure 4:
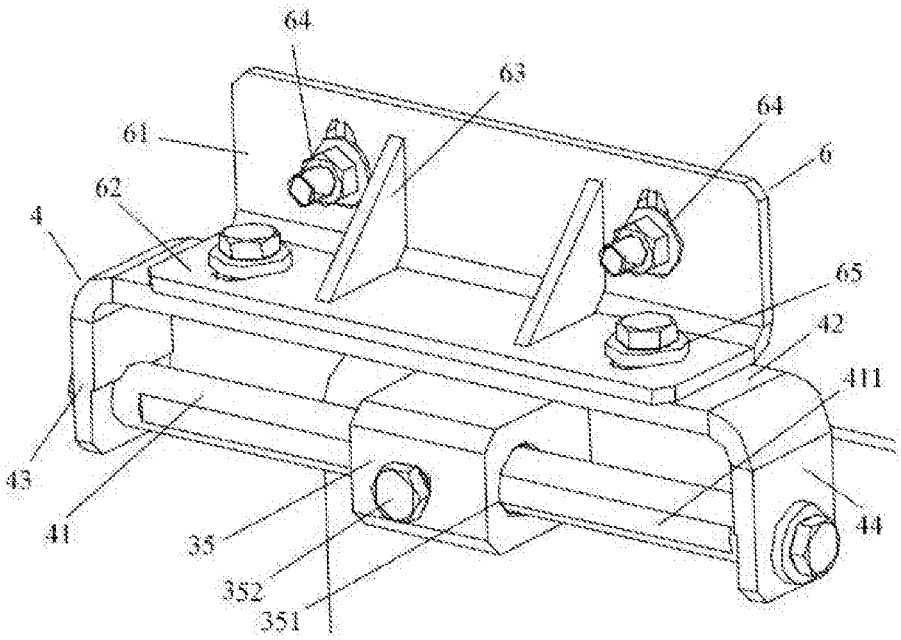
FIG. 4 is a perspective view of the second component and the guiding mechanism of the handrail belt tension device of the invention.

Preferably, as shown in FIGS. 3 and 4, the guiding mechanism 4 comprises an illustrated guide rod 41, and further comprises a body 42 and two projections 43, 44 integrally formed with the body 42 on the same side (lower side as shown) of the body. One end of the guide rod 41 is fixedly mounted (for example, by a fastening bolt as shown) on the projection 43, and the other end is fixedly mounted on the projection 44. The base plate 3 includes a first protrusion 35 projecting from the base plate, the protrusion 35 having a first through hole 351 allowing the guide rod 41 to pass therethrough so as to allow the first protrusion 35 and the base plate 3 to rotate around the guide rod 41 and translate along the length direction of the guide rod 41. Alternatively, the first protrusion 35 may be an individual block that is directly fixed to the base plate 3 by, for example, welding. After the base plate 3 is adjusted to a proper position, the first protrusion 35 is fixed to the guide rod 41 by the first fastener 352. For example, the first fastener 352 can be a hex bolt. The guide rod 41 includes a flat surface 411 extending in its length direction, for engaging with the trailing end of the first fastener 352, thereby facilitating the screwing operation, and thereby the connection between the first protrusion 35 and the guide rod 41 is more reliable.

It will be understood by those skilled in the art that the guiding mechanism 4 may also have the form of an cylindrical pin with an opening (not shown in the accompanying drawings) which is hollow and slotted in the entire axial direction so that the cylindrical pin has a substantially C shaped cross-section. Correspondingly, the protrusion of the base plate 3 also has a cylindrical outer contour, whereby the cylindrical pin with an opening allows the protrusion to move therein so as to allow the protrusion and the base plate 3 to rotate and translate relative to the cylindrical pin.

After the base plate 3 is adjusted to an appropriate position, the base plate 3 can also be directly fixed to the truss with at least one second fastener 33. In a preferred embodiment shown in FIG. 2, the base plate 3 is directly secured to the truss by two T long bolts to ensure the stability of the handrail belt tension device during the operation of the handrail belt 2. Thus, when the handrail belt 3 is re-tensioned, only by loosening the first fastener 352 and the second fastener 33, the base plate 3 can be conveniently adjusted along the length of the guide rod 41, or rotationally adjusted relative to the guide rod 41, such that the base plate 3 can be quickly adjusted to the correct position.

Figure 5:
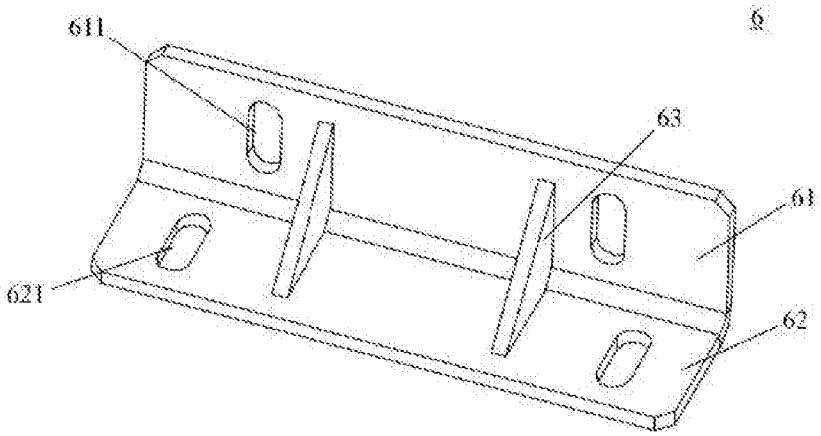
FIG. 5 is a perspective view of the second part of the handrail belt tension device of the invention.
Figure 6:
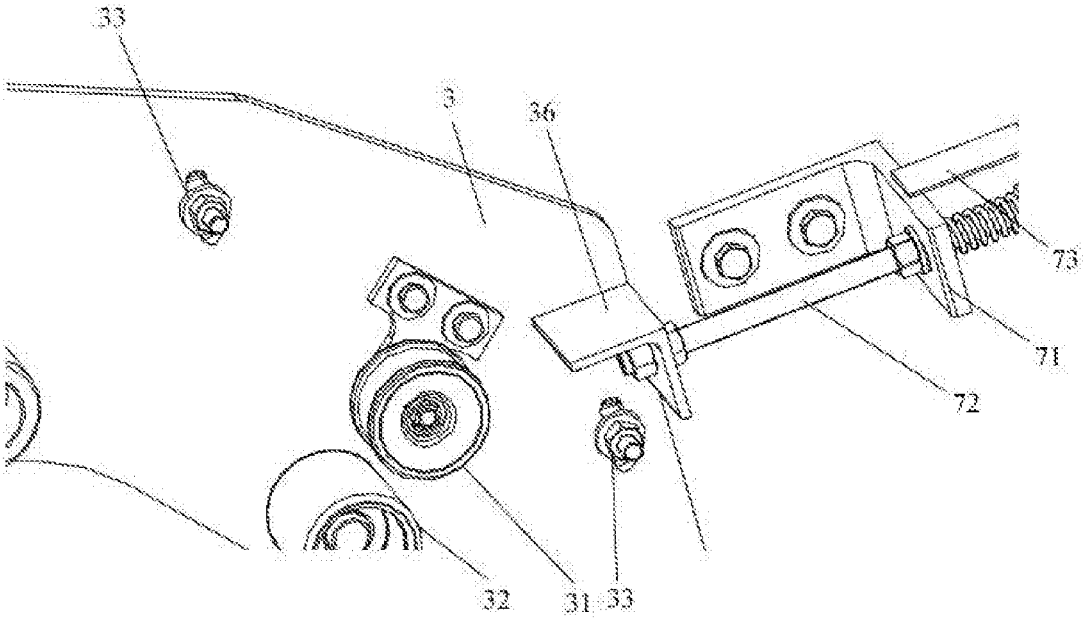
FIG. 6 is a view schematically showing a base plate and a tension mechanism of the handrail belt tension device of the invention.

Referring to FIGS. 4 and 5, the handrail belt tension device of the present invention may further comprise a first component 5 secured to the truss 1 and a second component 6 connected between the first component 5 and the guiding mechanism 4. Wherein the second component 6 comprises a first connecting part 61 and a second connecting part 62. Preferably, the first connecting part 61 is substantially perpendicular to the second connecting part 62. The first connecting part 61 and the second connecting part 62 are respectively fixed to the first component 5 and the guide mechanism 4 by at least one (two as illustrated) third fasteners 64 and at least one (two as illustrated) fourth fasteners 65, respectively. The second component 6 further includes a reinforcing rib 63 connected between the first connecting part 61 and the second connecting part 62.

Returning to FIG. 3, a long slot 51 oriented along the longitudinal direction X of the truss 1 can be provided on the first component 5, which the long slot allows the third fastener 64 to move therein to allow the second component 6 to translate along the longitudinal direction of truss 1. In the preferred embodiment illustrated, the length direction of the guide rod 41 of the guiding mechanism 4 is arranged parallel to the longitudinal direction X of the truss 1. It can be understood that the guide rod 41 may not be arranged parallel to the longitudinal direction of the truss 1 but angled as needed.

In addition, at least one first oblong hole 611 corresponding to the at least one third fastener 64 and oriented in the width direction Y of the truss 1 may be provided on the first connecting part 61 of the second component 6 to allow the third fastener 64 move therein, so as to allow the second component 6 to translate in the width direction Y of the truss 1.

Further, at least one second oblong hole 621 corresponding to the at least one fourth fastener 65 and oriented in the lateral direction Z of the truss 1 is provided on the second connecting part 62 to allow the fourth fastener 65 to move therein, thus to allow the guiding mechanism 4 to translate relative to the lateral direction Z of the truss 1.

In the above manner, when the tension device is installed, it can be adjusted in the longitudinal direction X of the entire truss 1 (i.e., the left-right direction with respect to the transverse beam 11 as shown), the width direction Y (the up-down direction with respect to the transverse beam 11), and the lateral direction Z (the front-rear direction as shown). Not only that, the rotational adjustment around the X direction can be performed. The problem that the base plate 3 of the tension device is difficult to adjust to the correct position is therefore improved, and the support roller 32 and the guide roller 33 can be conveniently placed in a correct, undeflected position.

Optionally, at least one jackscrew 34 (FIG. 3) is provided on the base plate 3, and the distance between the base plate 3 and the vertical beam behind the base plate 3 can be adjusted by adjusting the jackscrew 34.

Figure 7:
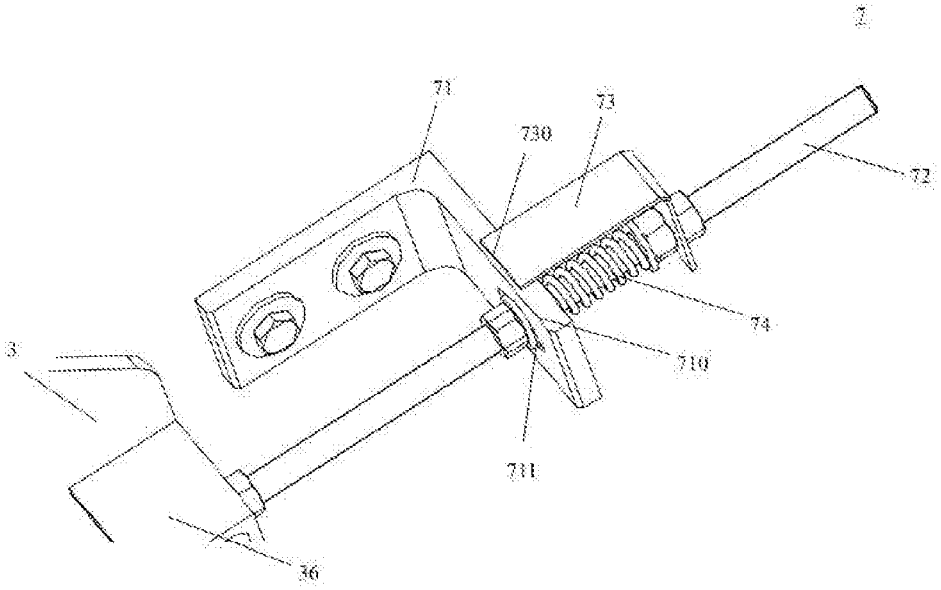
FIG. 7 is a perspective view of the tension mechanism of the handrail belt tension device of the invention.

Referring to FIGS. 3 and 7, the handrail belt tension device of the present invention further includes a tension mechanism 7 including a first part secured to the truss 1 and a second part movable relative to the first part, the second part being connected to the base plate 3 to drive the base plate 3 to move together. Wherein the first part includes a bracket 71 that can be fixed to the support plate 14 of the truss 1 by a fastening bolt, the bracket 71 having a second through hole 711 oriented in a direction parallel to the length direction of the guide rod 41; the second part includes a tension rod 72, the second through hole 711 allowing the tension rod 72 to pass therethrough so as to allow the tension rod 72 to rotate relative to the bracket 71 and to translate in a direction parallel to the length direction of the guide rod 41. Preferably, the base plate 3 includes a second protrusion 36 secured thereto, and the second protrusion may be an angled member as shown in the figure, or may have other forms. The tension rod 72 is fixedly connected to the second protrusion 36 by means of fasteners such as bolts in order to drive the base plate 3 to move with the tension rod 72.

The second part 6 further includes a ruler 73 disposed on the tensioning rod 72 and having a predetermined length, and a spring 74 located between the bracket 71 and the ruler 73 such that, the spring 74 is compressed as the ruler 73 moves toward the bracket, and that a designated edge of the ruler 73 (e.g., the edge 730 as shown) can be substantially aligned with corresponding edge 710 of the bracket 71 when the spring 74 is compressed to a predetermined length, thereby indicating to the operator that the handrail belt 2 is in a reasonably tensioned status. In the preferred embodiment illustrated, the tension rod 72 is a threaded pole that can be secured to the bracket 71 by a nut, and the ruler 73 can be secured to one end of the tension rod 72 by a nut.

As shown in FIG. 7, the ruler 73 is located between the other end of the tension rod 72 and the bracket 71 and is bent as shown in the figure, one end of the ruler 73 extending toward the bracket 8, and the other end being fastened to the tension rod 72 by a nut. The spring 74 is located between the ruler 73 and the through hole 711 of the bracket 71 and is sleeved on the tension rod 7. The spring 74 is blocked by the bracket 71. When the nut is screwed to move the ruler 73 toward the bracket 71 in order to start adjusting the base plate 3, the spring 74 is compressed. For accurately measuring the tensioning force of the handrail belt 2, length of the spring and length of the ruler are pre-designed according to the required tensioning force and the performance parameters of the spring 74. If the spring 74 is compressed to the pre-designed spring length by the tensioning force applied to the base plate 3 and the handrail belt 2, an edge 730 of the ruler 73 is substantially aligned with a corresponding edge of the bracket 71 (e.g., the edge 710) so that the operator can clearly know that the handrail belt is tensioned with the desired tensioning force, that is, in a state of reasonably tensioned. The operator can choose the corresponding two edges by his own, without necessarily using the edges as shown in the figure. The use of the ruler 73 helps to quickly press the spring 73 to the correct length to promptly determine if the tensioning force of the tension device is reasonable.

Figure 1:
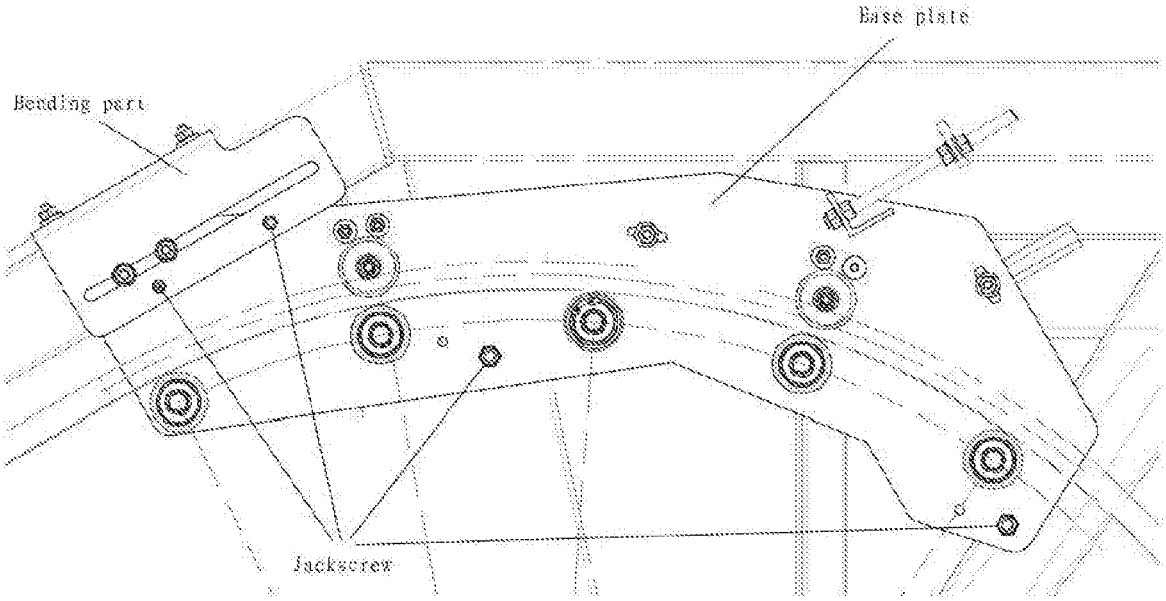
FIG. 1 is a schematic view of a conventional handrail belt tension device.

The solution of the prior art, using a bending part to connect the bottom plate of the tension device (see FIG. 1) and the bending part is fixed on the truss by T bolts, can only perform the adjustment in the left and right direction of the truss, but not in the up and down direction. Further, adjusting the nuts and the bolts when adjusting the bending part in the left and right direction is very troublesome, time consuming and laborious. Especially in cases at the customer's site, the escalator has been running for a long time, and the length of the handrail belt has changed, and thus it takes more time to loosen and tighten the nuts, bolts, T long bolts, jackscrews and to screw nuts to the bolts in order to re-adjust the tension of the handrail belt. Furthermore, due to the deviation of angle of the bending part, an accurate right angle cannot be guaranteed, and the welding error of the truss, the dimension error of the bending part, etc., all of these causing the support and the guiding rollers not in the correct position after the tension device is installed, and the rollers at the two ends even cannot contact with the handrail belt. The handrail belt would deviate from the correct track, and the running performance of the handrail belt would be affected, which further causes the handrail belt to wear. When the tension device is tightened by the tension bolt, the operator does not know the exact tensioning force and has to estimate by feeling. Therefore, it is very difficult to have the tensioning force in a reasonable range during operation, and at the end influence the lifetime of the handrail belt as well as the power consumption of the drive motor.

In the novel solution of this invention, the handrail belt tension device can be adjusted in the X, Y, and Z directions, and the base plate 3 can be rotated and translated simultaneously with respect to the guiding mechanism 4. Rough and fine adjustments can be easily and quickly performed. The support and guide rollers can be in the correct position to ensure normal operation of the handrail belt. When the handrail belt needs to be re-adjusted on site, simply loosen the first fastener 351 and the nut on the tension rod 72, and then screw the nut to compress the spring to find the most suitable position for the tensioning force. When the edge of the ruler 73 is again aligned with the corresponding edge of the bracket 71, it means that the handrail belt is in a good tensioned state. By this means, convenient and precise tension control is achieved, and the time required for such re-adjustment is significally reduced than that of the prior art.

The solution of the present invention is generally applicable to almost all escalators that need to be re-adjusted at regular intervals.

Variations and modifications of the various embodiments described herein can be made by those skilled in the art without departing from the scope of the invention as defined by the appended claims. In addition, descriptions of well-known functions and constructions may be omitted for clarity and conciseness.

Finally, it should also be understood that certain technical features in the embodiments may not be necessary to solve a specific technical problem, so that these technical features may be omitted without affecting the solution of the technical problem or the formation of the technical solution. The features, elements, and/or functions of one embodiment may be combined, incorporated, or cooperated with the features, elements, and/or functions of the other embodiments, unless the combination, incorporation, or cooperation is obviously not be able to implemented.

What is claimed is:

1. A handrail belt tension device for an escalator, the escalator comprising a truss and an annular handrail belt rotatable relative to the truss, wherein the handrail belt tension device comprises:

a base plate on which a roller for supporting the handrail belt is provided; and a guiding mechanism which is fixed to the truss, wherein the base plate is connected to the guiding mechanism, and rotatable and translatable relative to the guiding mechanism so as to adjust the handrail belt by the base plate thereby the handrail belt can be in a well tensioned status, wherein the guiding mechanism comprises a guide rod, and the base plate comprises a first protrusion fixed on the base plate and having a first through hole, and wherein the first through hole allows the guide rod to pass therethrough so as to allow the first protrusion and the base plate to rotate about the guide rod and translate along the length direction of the guide rod, and after the base plate is adjusted into position, the first protrusion can be fixed to the guide rod by a first fastener.

2. The handrail belt tension device for an escalator according to claim 1, wherein the base plate can be fixed directly to the truss by at least one second fastener.

3. The handrail belt tension device for an escalator according to claim 1, wherein the guide rod includes a flat surface extending along the length direction thereof for engaging with the first fastener.

4. The handrail belt tension device for an escalator according to claim 1, further comprising a tension mechanism including a first part fixed to the truss and a second part movable relative to the first part, the second part being connected to the base plate so as to move the base plate together with it.

5. The handrail belt tension device for an escalator according to claim 4, wherein the first part includes a bracket fixed to the truss and having a second through hole oriented parallel to the length direction of the guide rod, and the second part includes a tension rod, the second through hole allowing the tension rod to pass therethrough so as to allow the tension rod to rotate relative to the bracket and translate in a direction parallel to the length direction of the guide rod.

6. The handrail belt tension device for an escalator according to claim 5, wherein the tension rod is fixedly connected to the base plate, and the second part further comprises a ruler having a predetermined length and disposed on the tension rod, and a spring located between the bracket and the ruler such that, the spring is compressed as the ruler moves toward the bracket, and that, a designated edge of the ruler can be substantially aligned with corresponding edge of the bracket when the spring is compressed to a predetermined length, thereby indicating to the operator that the handrail belt is in a reasonably tensioned status.

7. The handrail belt tension device for an escalator according to claim 6, wherein the base plate further comprises a second protrusion fixed to the base plate for fixed connection with the tension rod.

8. The handrail belt tension device for an escalator according to claim 6, wherein the tension rod is a threaded rod and can be fixed to the bracket by a nut, and the ruler can be fixed to the threaded rod by a nut.

9. The handrail belt tension device for an escalator according to claim 1, further comprising a first component fixed to the truss and a second component connected between the first component and the guiding mechanism.

10. The handrail belt tension device for an escalator according to claim 9, wherein the second component comprises a first connecting part and a second connecting part disposed substantially perpendicular to the first connecting part, the first connecting part and the second connecting part being respectively fixed to the first component and the guiding mechanism by at least one third fastener and at least one fourth fastener, respectively.

11. The handrail belt tension device for an escalator according to claim 10, wherein the second component further comprises at least one rib connected between the first connecting part and the second connecting part.

12. The handrail belt tension device for an escalator according to claim 10, wherein the first component is provided with a long slot oriented along the longitudinal direction of the truss, the long slot allowing at least one third fastener to move therein so as to allow the second component to translate along the longitudinal direction of the truss.

13. The handrail belt tension device for an escalator according to claim 12, wherein the length direction of the guide rod is arranged parallel to the longitudinal direction of the truss.

14. The handrail belt tension device for an escalator according to claim 10, wherein the first connecting part is provided with at least one first oblong hole corresponding to at least one third fastener and oriented along the width direction of the truss to allow at least one third fastener to move therein so as to allow the second member to translate along the width direction of the truss.

15. The handrail belt tension device for an escalator according to claim 10, wherein the second connecting part is provided with at least one second oblong hole corresponding to at least one fourth fastener and oriented along the transverse direction of the truss to allow at least one fourth fastener to move therein so as to allow the guiding mechanism to translate along the transverse direction of the truss.

16. An escalator comprising a handrail belt tension device for an escalator according to claim 1.

* * * * *